United States Patent [19]

Töpperwien et al.

[11] Patent Number: 4,548,113

[45] Date of Patent: Oct. 22, 1985

[54] PERFORATING DEVICE

[75] Inventors: Bernd Töpperwien, Rossdorf; Lothar Krause, Riedstadt, both of Fed. Rep. of Germany

[73] Assignee: Maschinenfabrik Goebel GmbH, Darmstadt, Fed. Rep. of Germany

[21] Appl. No.: 614,562

[22] Filed: May 29, 1984

[30] Foreign Application Priority Data

May 28, 1983 [DE] Fed. Rep. of Germany ..... 3319512

[51] Int. Cl.[4] ..... B26F 1/08

[52] U.S. Cl. ..... 83/345; 83/670; 83/686; 83/690; 83/698

[58] Field of Search ..... 83/345, 343, 670, 685, 83/686, 690

[56] References Cited

U.S. PATENT DOCUMENTS

| | | | |
|---|---|---|---|
| 1,649,635 | 11/1927 | Williard | 83/345 |
| 2,116,391 | 5/1938 | Gochoel | 83/345 |
| 2,264,134 | 11/1941 | Hawley | 83/345 |
| 2,378,806 | 6/1945 | Stellin | 83/698 X |
| 3,106,859 | 10/1963 | Huffman | 83/345 |
| 3,192,810 | 7/1965 | Amato | 83/345 X |
| 3,194,095 | 7/1965 | Buck et al. | 83/345 X |
| 3,602,080 | 8/1971 | Sickel | 83/670 X |
| 3,828,632 | 8/1974 | Grano | 83/670 X |
| 4,094,185 | 6/1978 | Wang | 83/686 X |
| 4,273,015 | 6/1981 | Johnson | 83/670 |
| 4,434,690 | 3/1984 | Mauer | 83/698 |

FOREIGN PATENT DOCUMENTS

| | | | |
|---|---|---|---|
| 994539 | 6/1965 | United Kingdom | 83/698 |

*Primary Examiner*—Donald R. Schran

*Attorney, Agent, or Firm*—Watson, Cole, Grindle & Watson

[57] ABSTRACT

A device for perforating a web or sheet of material, includes a rotatable male die carrier roll having at least one radially extending cylindrical bore opening into its outer periphery, and a male die holder comprising a hollow cylinder having an outer diameter substantially equal to the diameter of the bore and being removably located within the bore. The outer and inner cylindrical surfaces of the hollow cylinder are substantially smooth, and the cylinder has a through slit extending in a radial direction completely between such surfaces and completely between opposite ends thereof. And, means are provided for applying an external force against the cylinder for frictionally holding a male die member in place therewithin, the slit in the cylinder permitting it to yield to such force supplying means.

7 Claims, 6 Drawing Figures

FIG 2
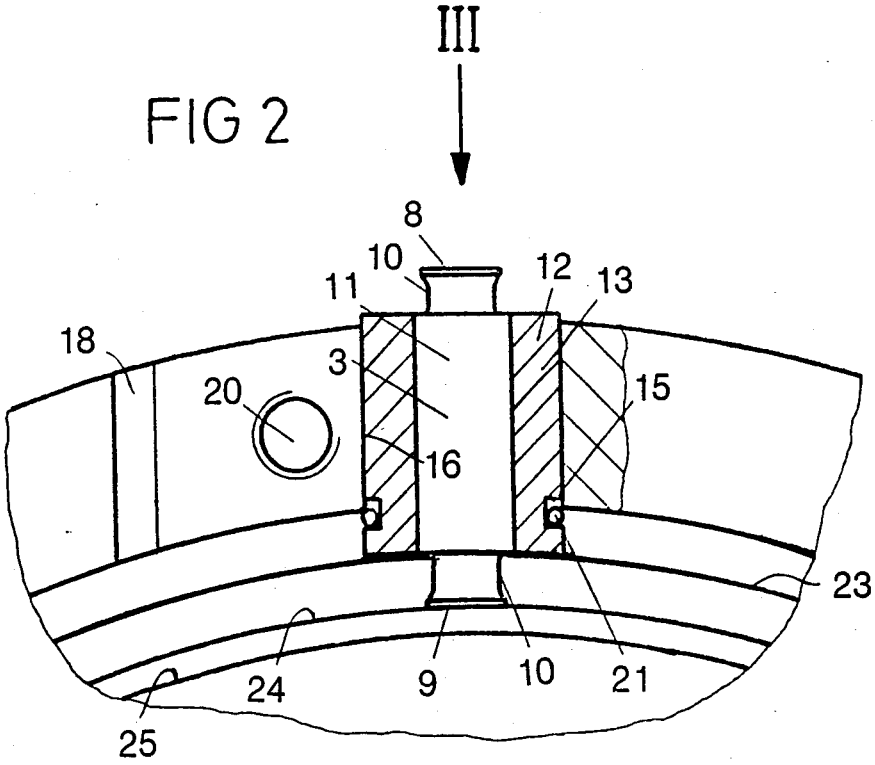
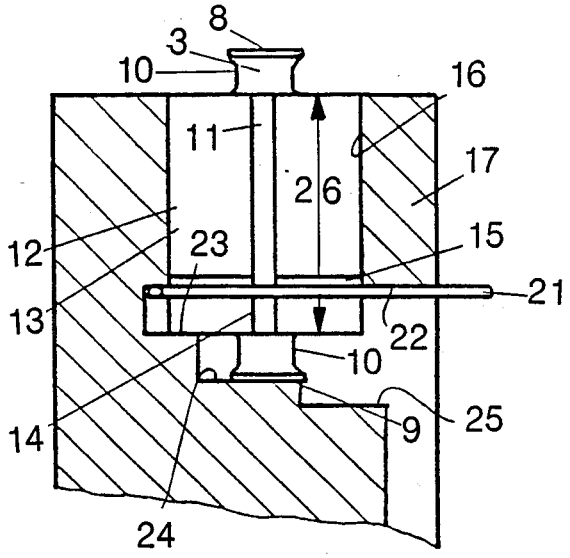
FIG 4

FIG 5
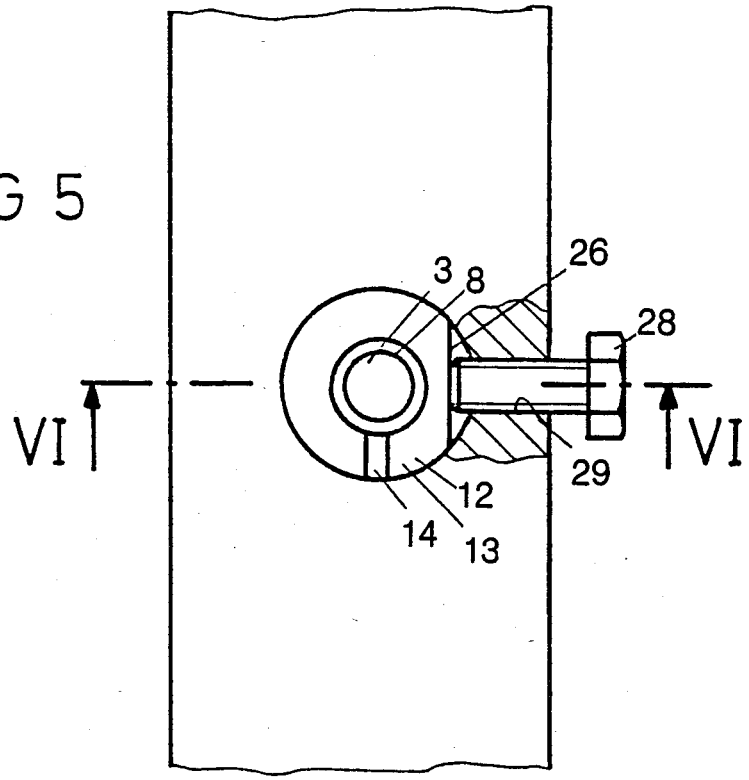
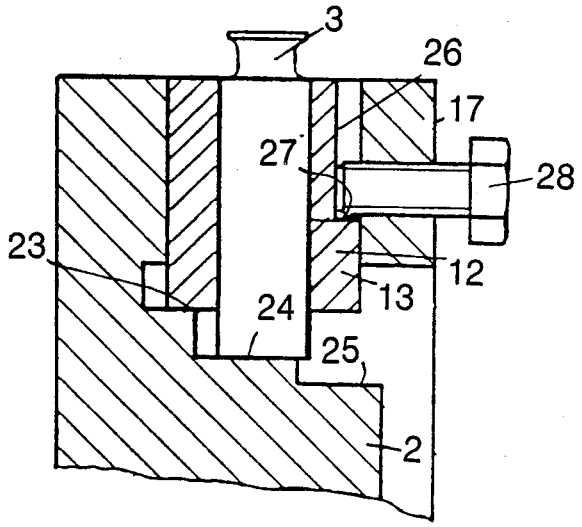
FIG 6

PERFORATING DEVICE

BACKGROUND OF THE INVENTION

This invention relates to a device for perforating a web or sheet of material made of paper, plastic, metal, fabric or other like materials, and includes a rotatable male die carrier roll having at least one radially extending bore opening into the outer periphery thereof for the reception of a removable and interchangeable male die member held in place within a hollow cylinder removably and interchangeably received within the bore.

Devices of this type are employed to punch holes into the web or sheet of material, the holes normally being circular although they may possibly be of square or triangular shape.

The holes may define feed holes for feeding the web or sheet through a web or sheet processing machine such as a cutter, high speed printer, etc. Otherwise, the punched holes may facilitate the fastening together or superposed webs or sheets, or may facilitate other applications.

U.S. Pat. No. 1,649,635 discloses a perforating device which comprises a pair of cooperating rolls having outer, axially extending grooves for the reception of male and female die holders and inserts for positioning the holders predetermined distances from one another in the grooves. The holders are of T-shaped cross-section and are therefore costly to produce. Moreover, the dies, especially the male dies, are not easily exchangeable or removable from the holders.

Another perforating device is disclosed in U.S. Pat. No. 3,706,250 in which male dies are interchangeable in a corresponding cylindrical roll. However, the cylindrical roll is designed in such a manner that only male dies with the same geometric dimensions can be interchanged.

SUMMARY OF THE INVENTION

It is therefore an object of the present invention to provide a perforating device in such a manner that die members having various geometric dimensions can be employed using the same cylindrical rolls, such that each die member can be interchanged for a new and unused one in a simple and economical yet highly efficient manner.

Another object of the invention is to provide such device wherein the male die holder comprises a hollow cylinder having substantially smooth inner and outer cylindrical walls, and the cylinder having a slit extending in a radial direction completely between such walls and completely between opposite ends of the cylinder, means being provided for applying an external force against the cylinder for frictionally holding a male die member in place within the hollow cylinder, the slot permitting the cylinder to yield to the force applying means.

A further object of this invention is to provide one embodiment of such a device wherein the hollow cylinder has a complete annular groove in its outer wall adjacent its inner end, and cylinder retention means engage the groove for removably retaining the cylinder within the bore. Such retention means may comprise a clamp spring in engagement with the groove and with the carrier roll. Cylinder retention means are also provided on the carrier roll in engagement with the cylinder, and the cylinder may in one embodiment have shoulder means engaged by such retention means for removably retaining the cylinder within the bore. Such shoulders means may define by a partially flat section of the outer wall of the cylinder, and such retention means may comprise the shank of a threaded fastener such as a bolt. And, the force applying means may include the threaded fastener in engagement with the carrier roll. In another embodiment, the carrier roll has a slit extending the length of the bore and extends between the bore and the outer surface of the carrier roll, and a bolt extends through the slit for retaining the male die member in place within the hollow cylinder.

Other objects, advantages and novel features of the invention will become more apparent from the following detailed description of the invention when taken in conjunction with the accompanying drawings.

BRIEF DESCRIPTION OF THE DRAWINGS

FIG. 2 is a partial enlargement of the upper roll carrier of FIG. 1;

FIG. 4 is a cross-sectional view taken substantially along the line IV—IV of FIG. 3;

FIG. 5 is a view similar to FIG. 3 of another embodiment according to the invention; and FIG. 6 is a cross-sectional view taken substantially along the line VI—VI of FIG. 5.

DETAILED DESCRIPTION OF THE INVENTION

Figure 1:
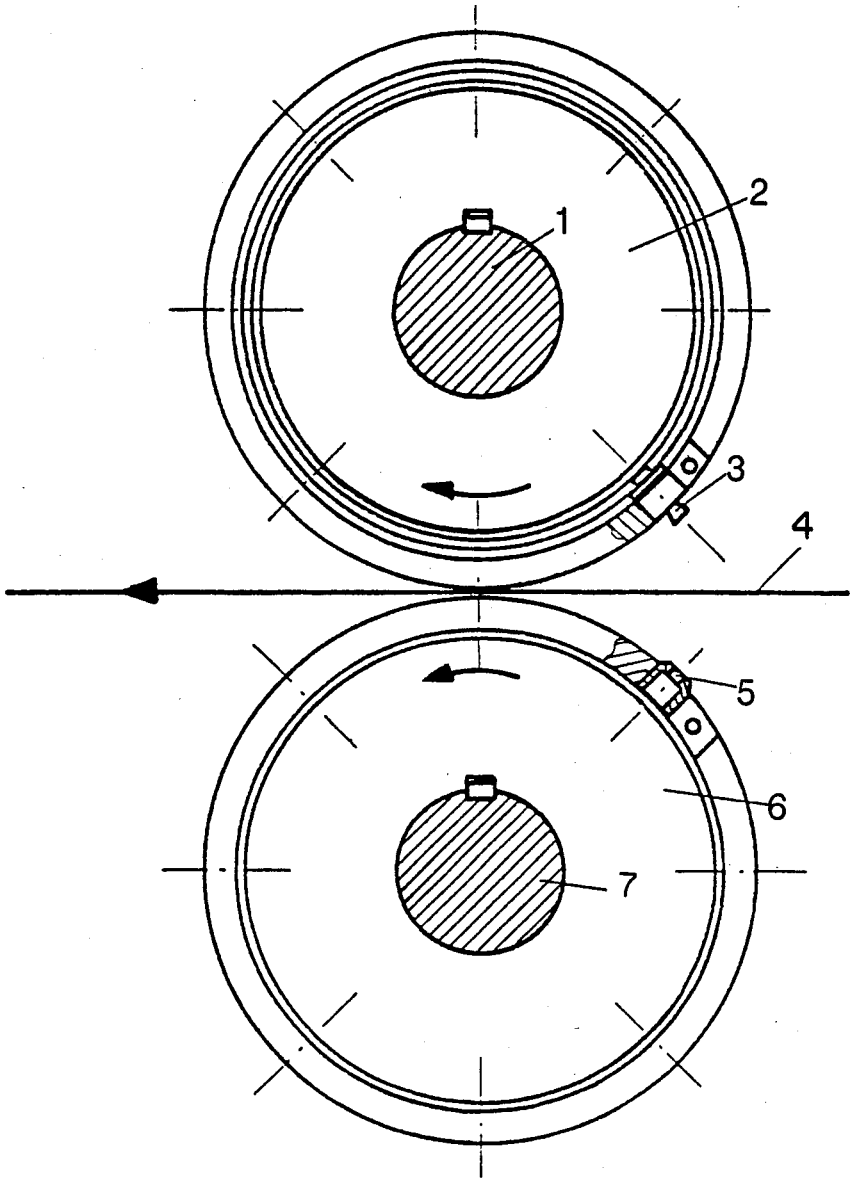
FIG. 1 is a side elevational view, partly in section, of the perforating device according to the invention.

Turning now to the drawings wherein like reference characters refer to like and corresponding parts throughout the several views, an axle 1 of a male die carrier roll 2 mounted thereon for rotation therewith, is rotatably mounted on a perforating machine frame (not shown), and the axle is driven in any normal manner. A plurality of male die members 3 are mounted on carrier roll 2 (although only one such member is shown in the interest of clarity) for perforating a strip or web 4 of material. As usual, the male die members work in coordination with female die members 5 mounted on a female die carrier roll 6 which is in turn mounted on a shaft 7 for rotation therewith. At least one male die member and at least one female die member are mounted on their respective carrier rolls, although a plurality of such cooperating die members are mounted on the carrier rolls respectively spaced apart equal or unequal distances over the circumferences of the rolls. In FIG. 1, for example, eight positions for the die members are indicated by dash-dot radial lines, although fewer or more than eight cooperating die members may be conveniently mounted.

Shaft 7 is likewise mounted for rotation on the machine frame (not shown) similarly as shaft 1 such as to rotate together in synchronization. Such can be effected via one-one gearing provided on shafts 1 and 7 in meshing engagement.

As more clearly shown in FIG. 2, male die members 3 are each provided at the outer end with a cutter 8, or cutters 8 and 9 on opposite ends. Each of the cutters is offset as at 10 from body 11 of the male die member. And, other than cutters 8, 9 and offset portions or necks 10 thereof, body 11 is cylindrical and has a smooth outer surface.

Body 11 of the male die member is mounted within a connecting holder 12 in the form of a relatively thick-walled hollow cylinder 13 having smooth inner and outer cylindrical surfaces. The cylinder has a through slit 14 extending in a radial direction completely between these surfaces and completely between opposite ends of the cylinder. And, the cylinder has a complete annular groove 15 in its outer surface adjacent its inner end.

Figure 3:
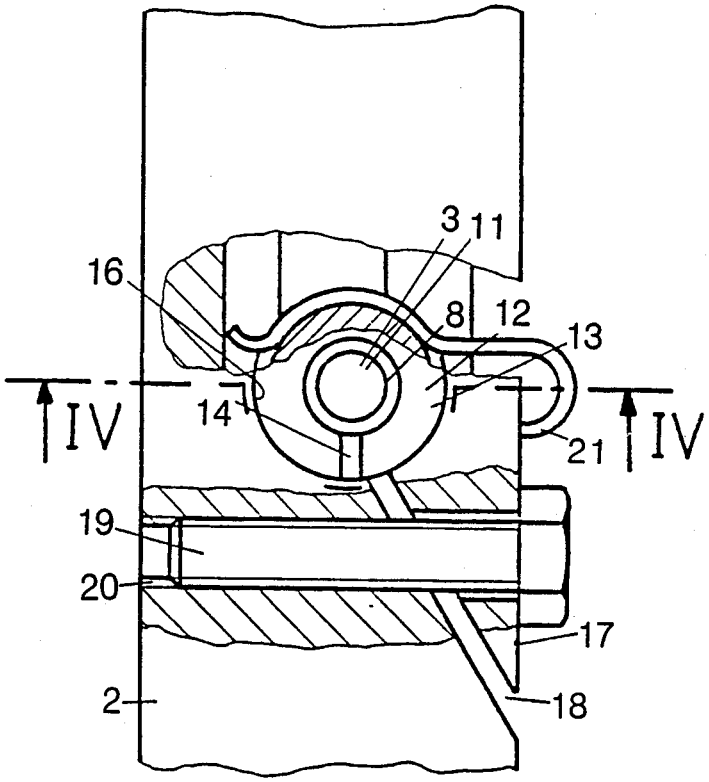
FIG. 3 is a plan view taken substantially in the direction of arrow III of FIG. 2.

Carrier roll 2 has a number of cylindrical bores 16, depending on the number of male die members to be accommodated, extending radially and opening into the outer periphery thereof as clearly shown in FIGS. 3 and 4. A hollow cylinder 13 is mounted in each bore 16 as shown in the drawings. And, carrier roll 2 has an open slit 18 associated with each bore 16, the slit extending between the bore and an outer surface 17 of the carrier roll, and extending the full axial extent of bore 16. A threaded fastener such as a bolt 19 extends through slit 18 into a threaded opening 20 in roll carrier 2. Thus, an external force is applied against the hollow cylinder for frictionally holding the male die member in place therewithin upon a tightening of bolt 19 causing the width of slit 18 to narrow as the outer segment of the roll carrier underlying the head of the bolt is pressed inwardly. Slit 14 in the hollow cylinder permits the cylinder to yield to the force applied by the tightening of the bolt to thereby frictionally hold the male die member in place. A shim or washer (not shown) may be inserted within slit 18 for limiting the tightening of the bolts, if necessary.

A clamp spring 21, which may be of bent wire, can be inserted into groove 15 and in engagement with a shoulder 22 (FIG. 4) of the carrier roll for retaining the hollow cylinder in place within its bore. And, as seen in FIGS. 2 and 4, the carrier roll 2 is turned down during fabrication to present annular shoulders 23, 24 and 25. As shown, hollow cylinder 13 rests at its inner end on shoulder 23, and cutter 9 of the male die member rests against shoulder 24. However, if bore 16 and hollow cylinder 13 are correspondingly of smaller diameter, the inner end of the hollow cylinder may be made to rest on shoulder 24, and cutter 9 may rest against shoulder 25. And, certainly, if no cutter 9 is provided for body 11 of the male die member, the inner end of the body member itself will rest against either shoulder 24 or 25. And, by the provision of clamp spring 21, hollow cylinder 13 is fixed within its bore against outward movement in a radial direction caused by centrifugal forces during rotation of the male die carrier roll.

The installation of a new male die member 3 into carrier roll 2 is carried out in a simple manner by first inserting a matching hollow cylinder 13 having a slit 14 into each radially extending bore 16 from the outer periphery of the carrier roll. This hollow cylinder is fixed in its axial position within the carrier roll by the insertion of clamp spring 21 into groove 15 so as to prevent dislodgement of the hollow cylinder radially outwardly of the carrier roll. A suitable male die member 3 is then inserted into the hollow cylinder until its inner end bears against shoulder 23. Bolt 19 is then tightened for thereby applying an external force against the hollow cylinder for frictionally holding the male die member in place, slits 18 and 14 being narrowed during this tightening operation.

The male die members comprise simple turned parts which can be produced essentially in a continuous process. Connecting holders 12, which are essentially in the form of hollow cylinders 13, are also fabricated as turned parts which can be produced in a continuous process, at least for the most part.

Because of the relatively large diameter of bores 16, it is possible to insert connecting holders 12 into them having different inner diameters but the same outer diameters. Because of their simple construction, these connecting holders are readily exchangeable and are economical to produce, so that it is possible to insert male die members 3 having various outer body diameters, so long as the outer diameter of the male die member corresponds to the inner diameter of the hollow cylinder 13. And, it should be pointed out that the wall thickness of hollow cylinder 13 could be reduced to zero so that a suitably sized male die member 3 may be installed directly into bore 16.

Because of the various outer diameter sizes of the male die members made possible by a suitably provided hollow cylinder having a corresponding inner diameter, circular cutters 8 of the male dye members may vary for different sizes of the male die members, in size and/or in geometric shape. Thus, even though the cost of the male die members themselves may increase, depending on the variety of male dies required, the overall cost is reduced since the carrier roll 2 is the same and need not be replaced. Thus, the carrier roll need not be dismounted from the machine in an otherwise costly and time consuming manner for changing a production program and interchanging it for a new and different one.

In another embodiment of the invention according to FIGS. 5 and 6, a portion of the outer surface of hollow cylinder 13 is flattened as at 26 so as to present a shoulder 27. And, a threaded fastener such as a bolt 28 threadedly engages threaded opening 29 of the carrier roll and extends into the groove presented by flattened portion 26 so as to abut against shoulder 27. With such arrangement, the hollow cylinder is retained in its bore and is prevented from moving radially outwardly thereof under centrifugal force during rotation of the carrier roll. Thus, the need for groove 15 and spring 21 is eliminated.

Moreover, bolt 28 is provided for applying an external force to the hollow cylinder for frictionally holding the male die member in place therewithin, upon a tightening of the bolt causing slit 14 to narrow. Therefore, the need for bolt 19 and slit 18 is eliminated.

From the foregoing, it can be seen that it is possible to install die members of various shapes and sizes into a single roll carrier without replacing the roll carrier for each differently sized and shaped die member. Thus, it is possible to conveniently make different types of perforations with various shapes while utilizing the same rotatable roll carrier. And, the same roll carrier can be utilized for as many different applications as necessary. Moreover, the perforating device according to the invention is easy and economical to fabricate and to operate, is highly efficient and is essentially comprised of simple turned parts which can be produced inexpensively on a lathe in a continuous operation. Moreover, dulled and used cutters can be rapidly replaced by new ones.

Obviously, many other modifications and variations of the present invention are made possible in the light of the above teachings. It is therefore to be understood that within the scope of the appended claims the invention may be practiced otherwise than as specifically described.

What is claimed is:

1. A device for perforating a web or sheet of material, comprising a rotatable male die carrier roll having at least one radially extending cylindrical bore opening into the outer periphery thereof, a male die holder comprising a hollow cylinder having an outer diameter substantially equal to the diameter of said bore and being removably located within said bore, said outer diameter and the inner diameter of said cylinder being defined by substantially smooth inner and outer cylindrical surfaces, and said cylinder having a through slit extending in a radial direction completely between said surfaces and completely between opposite ends of said cylinder, and means for applying an external force against said cylinder for frictionally holding a male die member in place therewithin, said slit permitting said cylinder to yield to said force applying means.

2. The device according to claim 1, wherein said cylinder has a complete annular groove in said outer surface adjacent an inner end of said cylinder, and cylinder retention means engaging said groove for removably retaining said cylinder within said bore.

3. The device according to claim 2, wherein said retention means comprises a clamp spring in engagement with said groove and with said roll.

4. The device according to claim 1, wherein cylinder retention means on said roll engage said cylinder, and said cylinder having shoulder means engaged by said retention means for removably retaining said cylinder within said bore.

5. The device according to claim 4, wherein said outer surface of said cylinder is partially flat and defines said shoulder means, said retention means comprising a bolt shank.

6. The device according to claim 1, wherein said force applying means includes a threaded fastener in threaded engagement with said roll.

7. The device according to claim 1, wherein said roll has a slit extending the length of said bore and extending between said bore and an outer end surface of said roll, and said force applying means tending to close said slit.

* * * * *